US007214095B1

(12) United States Patent
Mathews

(10) Patent No.: US 7,214,095 B1
(45) Date of Patent: May 8, 2007

(54) SEALING SECURITY SHIELD

(75) Inventor: Roger D. Mathews, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/253,865

(22) Filed: Oct. 19, 2005

(51) Int. Cl.
*H01R 9/05* (2006.01)

(52) U.S. Cl. ..... 439/578; 439/274

(58) Field of Classification Search ..... 439/133–134, 439/271–274, 578
See application file for complete search history.

(56) References Cited

U.S. PATENT DOCUMENTS

| | | | |
|---|---|---|---|
| 242,388 | A | 5/1881 | Smith |
| 862,618 | A | 8/1907 | Dossert |
| 2,785,384 | A | 3/1957 | Wickesser |
| 3,181,105 | A | 4/1965 | Roach et al. |
| 3,601,761 | A | 8/1971 | Harris |
| 3,621,448 | A | 11/1971 | Arnold et al. |
| 3,643,207 | A | 2/1972 | Cairns |
| 3,643,208 | A | 2/1972 | Massa, Jr. |
| 3,792,418 | A | 2/1974 | Kailus |
| 3,847,463 | A | 11/1974 | Hayward et al. |
| 4,073,559 | A | 2/1978 | Lawson, Jr. |
| 4,090,759 | A | 5/1978 | Herrmann, Jr. |
| 4,180,301 | A | 12/1979 | Hutter |
| 4,447,103 | A | 5/1984 | Werth et al. |
| 4,545,633 | A | 10/1985 | McGeary |
| 4,611,872 | A | 9/1986 | Ito et al. |
| 4,674,818 | A | 6/1987 | McMills et al. |
| 4,676,574 | A | 6/1987 | Grosso et al. |
| 4,684,764 | A | 8/1987 | Luzzi et al. |
| 4,822,293 | A | 4/1989 | Robson |
| 4,824,386 | A | 4/1989 | Souders |
| 4,917,620 | A | 4/1990 | Samejima et al. |
| 5,120,268 | A | 6/1992 | Gerrans |
| 5,299,951 | A | 4/1994 | Blaetz |
| 5,437,563 | A | 8/1995 | Kihara et al. |
| 5,439,386 | A | 8/1995 | Ellis et al. |
| 5,502,280 | A | 3/1996 | Rocci et al. |
| 5,564,951 | A | 10/1996 | Attal et al. |
| 5,645,442 | A | 7/1997 | Cairns |
| 5,785,544 | A | 7/1998 | Linden et al. |
| 6,273,733 | B1 | 8/2001 | Uchiyama |
| 6,558,178 | B2 | 5/2003 | Nakamura |
| 2004/0082218 | A1 | 4/2004 | Stirling |
| 2005/0020128 | A1 | 1/2005 | Montena |
| 2005/0037651 | A1 | 2/2005 | Axenbock et al. |

*Primary Examiner*—Khiem Nguyen
(74) *Attorney, Agent, or Firm*—Pastel Law Firm; Christopher R. Pastel

(57) ABSTRACT

A security shield for a coaxial cable interconnection between a male connector and a female connector includes a gasket having a cross-section fitted to an annular shoulder of the security shield. When the security shield is fitted onto the coaxial cable interconnection, the gasket provides a seal between the security shield, the male connector, and the female connector. In an alternative embodiment, two gaskets are used which are fitted onto different parts of the annular shoulder of the security shield.

10 Claims, 3 Drawing Sheets

SEALING SECURITY SHIELD

FIELD OF THE INVENTION

This invention relates generally to the field of coaxial cable connectors, and more particularly to a coaxial cable connector with a security shield which protects the connector from unauthorized access, tampering, or theft, while providing a weather seal against moisture.

BACKGROUND OF THE INVENTION

A number of connectors are available to terminate a coaxial cable so as to connect the cable to various electronic devices, such as switches, distribution boxes, manifolds, and electronic devices. In a typical coaxial cable network, a "drop" cable is used to carry the signal, which may include analog or digital TV signals, internet signals, security monitoring signals, etc., from the rigid coaxial cable near the road to the end user's home. The connector in many cases has to be installed outside of the end user's home so that the servicing and installation personnel can perform troubleshooting as well as connecting and disconnecting the signal without entering the end user's premises. The connector is thereby exposed to weather elements, including periods of high moisture, temperature fluctuations, rain, snow, etc. In addition, as the connectors are installed outdoors, they are prone to unauthorized assess, tampering, or theft.

The drop cable typically has an elongated copper or a copper clad steel center conductor, surrounded by a dielectric in turn surrounded by a conducting braid and/or foil which is used as a shield, which is in turn surrounded by a polymer-based insulating jacket, typically made of PVC or PE.

A typical interconnection of the "F" female port and "F" male connector is shown in FIG. 1. The "F" female port and "F" male connector are interconnected and sealed with a sleeve which is independent of the connector but is dependent on the attachment of the "F" male connector to the "F" female port. The sleeve provides the critical protection against moisture. Inadequate sealing of the connection is known to cause a non-hermetic seal and thereby allow penetration of moisture into the interconnection. The signal quality is then compromised at the subscriber's location due to parasite electrical pathways between the center conductor and the shielding formed by moisture, as well as the oxidation and corrosion of the internal connector components and of the center conductor, with consequent deterioration of the quality of the connection.

Security shields protecting the interconnection and providing security against unauthorized access, theft, and tampering are known in the art. A typical security shield is a shell slideably fitting over the interconnection and preventing physical access. A special tool is commonly required to attach the security shield. Once the security shield is attached, it is impossible to disconnect the connectors without first removing the security shield. However, typical security shields are difficult to fit over the sealing sleeves such as shown in FIG. 1 due to spatial constraints.

U.S. Pat. No. 4,824,386 discloses a security connector with a shield 22*b* and a retaining ring 152 in FIGS. 4 and 5. There is no provision for a weather seal. The retaining ring 152 cannot provide any weather seal or perform sealing gasket-like functions being cut in the middle.

U.S. Pat. No. 4,822,293 discloses a sealing housing 10 which includes a tubular member 12 and two O-rings 40 and 46. Although not a security sleeve, housing 10 is very similar to one. This design requires a complicated assembly and insertion of gaskets 40 and 46 which can fall off during the connector assembly without the assembler noticing.

U.S. Pat. No. 4,674,818 discloses a hollow elastically deformable sealant member 180 which provides a weather seal between the male and female "F" connectors. This sealing apparatus is similar to the prior art embodiment shown in FIG. 1, and is subject to leakage through the treads of the male threaded member, especially when exposed to temperature fluctuations when in service. Another disadvantage of this sealing apparatus is the extra part of the assembly represented by the elastically deformable sealant member and the extra time required when performing assembly in the field.

U.S. Pat. No. 4,545,633 discloses an O-ring 124 (FIG. 2) which seals between outer shell 98 and tubular component 68 of housing 66. Outer shell 98 performs a locking function similar to a security shield.

U.S. Pat. No. 5,439,386 discloses a locking member 100 (FIGS. 7, 7A, 7B) with O-rings 38 and 154 providing a seal between the locking member, chassis mounting portion 6, and adaptor 8. This is a complicated design requiring complex assembly and multiple sealing gaskets.

None of the prior art has addressed the tight weather seal requirements for the "F" interconnection as well as the security shielding requirements, along with the concomitant need to prevent direct detaching or loosening of the connector from the mating port, unauthorized access, tampering, and theft, in an economic, easy to assemble, and compact package. The complexity of design and number of required parts makes some of these connectors impractical and expensive to manufacture. In addition, the procedures required to assemble these connectors in the field, often in inclement weather conditions, are complicated.

SUMMARY OF THE INVENTION

Briefly stated, a security shield for a coaxial cable interconnection between a male connector and a female connector includes a gasket having a cross-section fitted to an annular shoulder of the security shield. When the security shield is fitted onto the coaxial cable interconnection, the gasket provides a seal between the security shield, the male connector, and the female connector. In an alternative embodiment, two gaskets are used which are fitted onto different parts of the annular shoulder of the security shield.

According to an embodiment of the invention, a security shield for a coaxial cable interconnection between a male connector and a female connector includes an annular shoulder on the security shield; the annular shoulder being disposed on an end of the security shield and extending orthogonally inward towards a longitudinal axis of the security shield; and a gasket having a U-shaped cross-section fitted to the annular shoulder of the security shield; wherein when the security shield is fitted onto the coaxial cable interconnection, the gasket provides a seal between the security shield, the male connector, and the female connector.

According to an embodiment of the invention, a security shield for a coaxial cable interconnection between a male connector and a female connector includes an annular shoulder on the security shield; the annular shoulder being disposed on an end of the security shield and extending orthogonally inward towards a longitudinal axis of the security shield; the annular shoulder having a first planar portion at an end of the security shield, an interior circumference, and a second planar portion extending from the interior circumference to an interior circumference of the security shield, wherein the first planar portion and the second planar portion are parallel to each other and orthogonal to the longitudinal axis of the security shield; a first gasket having an L-shaped cross-section fitted to an edge of the annular shoulder where the first planar portion and the interior circumference meet; and a second gasket having a flattened S-shaped cross section fitted to an edge of the annular shoulder where the second planar portion and the interior circumference meet; wherein when the security shield is fitted onto the coaxial cable interconnection, the first gasket provides a seal between the security shield and the female connector, and the second gasket provides a seal between the security shield, the female connector, and the male connector.

According to an embodiment of the invention, a method of manufacturing a security shield includes the steps of providing a security shield, the security shield having an annular shoulder on an end of the security shield and extending orthogonally inward towards a longitudinal axis of the security shield, the annular shoulder having a first planar portion at an end of the security shield, an interior circumference, and a second planar portion extending from the interior circumference to an interior circumference of the security shield, wherein the first planar portion and the second planar portion are parallel to each other and orthogonal to the longitudinal axis of the security shield; and fitting a first gasket to the annular shoulder of the security shield, wherein when the security shield is fitted onto the coaxial cable interconnection, the first gasket provides a seal between the security shield, the male connector, and the female connector.

DETAILED DESCRIPTION OF THE PREFERRED EMBODIMENT

Figure 1:
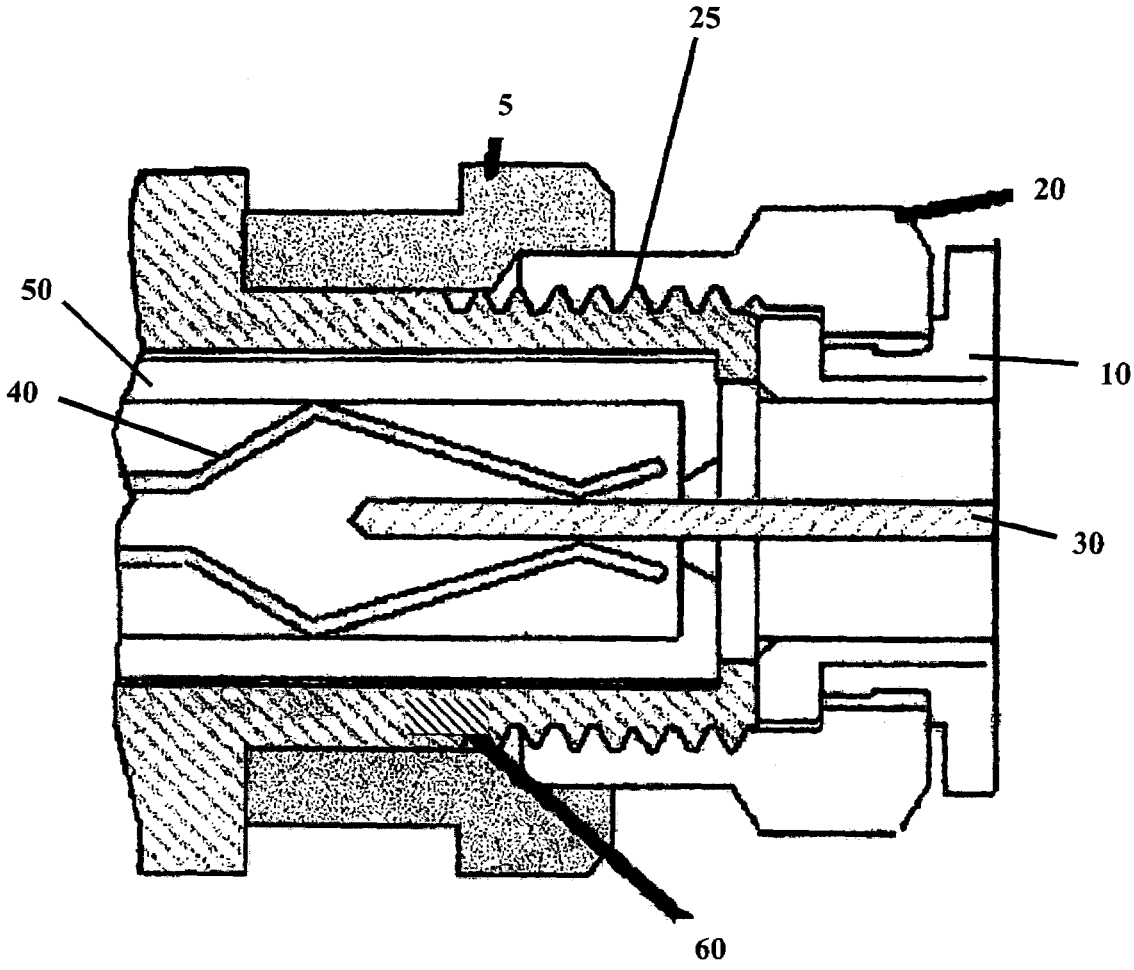
Fig 1 PRIOR ART
FIG. 1 shows a sectional view of a typical interconnect with a weather seal according to the prior art.

Referring to FIG. 1, a typical interconnect of an "F" male connector 10 and an "F" female port 60 with a weather seal 5 is shown. The sealing function is independent of the connector but dependent on the attachment of the "F" male connector to the "F" female port, as is known in the art. A pin 30 of male connector 10 is engaged by a female port receptacle 40 thus establishing an electrical connection. Female port receptacle 40 is preferably disposed inside an insulating housing 50 as is known in the art. A nut 20 rotatably attached to male connector 10 provides a mechanical connection between male connector 10 and female port 60 by engaging threads 25 on the body of female port 60. A moisture seal is achieved through compression of weather seal 5 against nut 20 and female port 60 thus establishing a weather-resistant seal. Although weather seal 5 provides the critical protection against moisture, a security shield is difficult to fit over the sealing sleeves due to spatial constrains.

Figure 2:
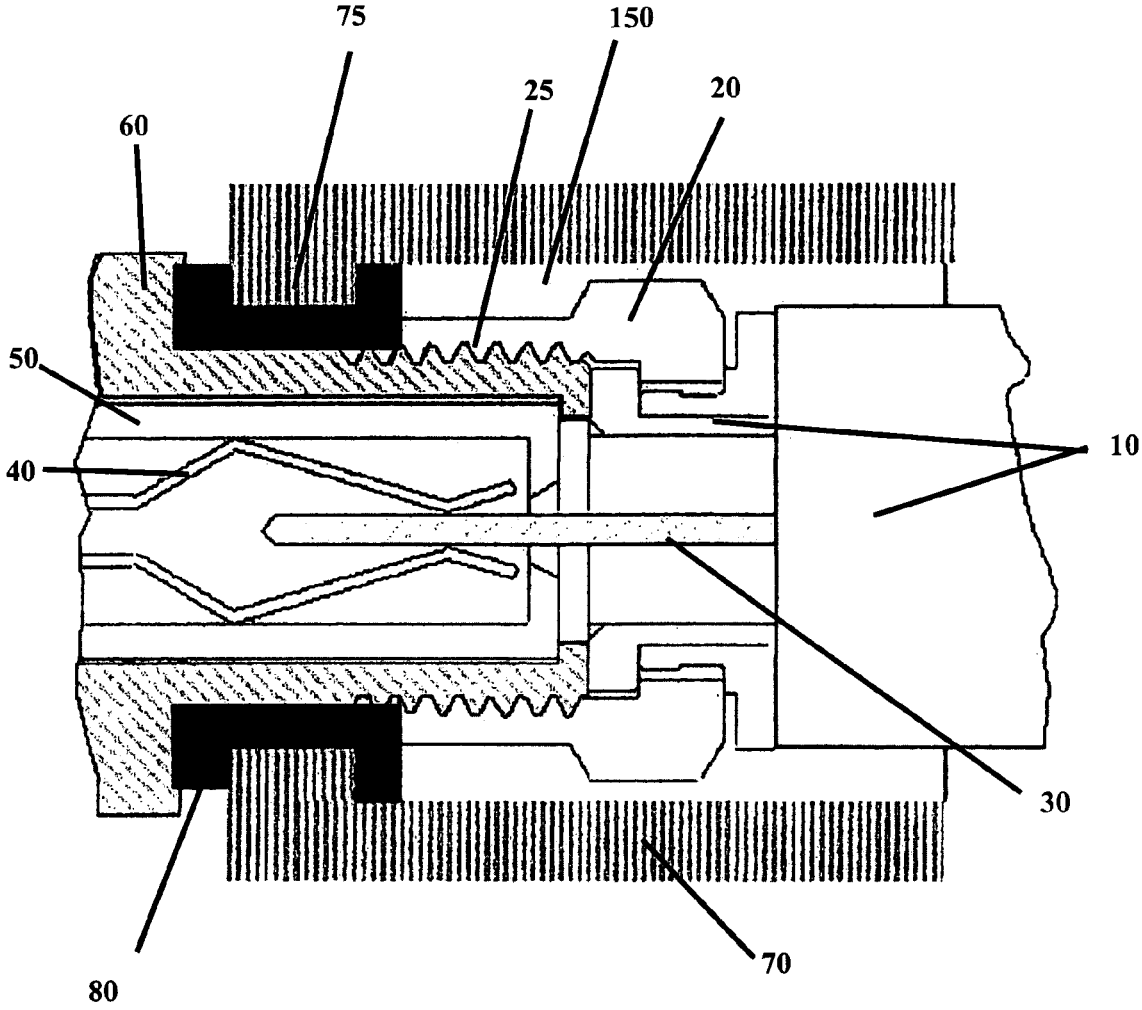
FIG. 2 shows a sectional view of a sealing security shield according to an embodiment of the invention.

Referring now to FIG. 2, a sectional view of the interconnection of "F" male connector 10 and "F" female port 60 with a sealing security shield 70 is shown according to an embodiment of the invention. An annular gasket 80, of a suitable material such as a silicone rubber or any other elastomeric material, with a U-type cross-sectional shape, is included in substantially cylindrical security shield 70 at an end of security shield 70 proximal to female port 60. Security shield 70 provides mechanical protection to male connector 10 and female connector 60 by mechanically shielding the interconnect area as well as nut 20 of male connector 10 which engages threads 25 of female port 60.

The portion of security shield 70 that prevents access to the interconnect area is substantially a hollow cylindrical member with an internal annular shoulder 75 at the end proximal to female port 60. Gasket 80 is placed onto security shield 70 to fit around annular shoulder 75. When security shield 70 is installed, gasket 80 provides a weather and moisture seal by being compressed against female port 60 and nut 20 of male connector 10. Thus moisture cannot penetrate into an annular space 150 formed between security shield 70, male connector 10, and nut 20. Moisture also cannot penetrate through threads 25 into receptacle 40 port 60.

Figure 3:
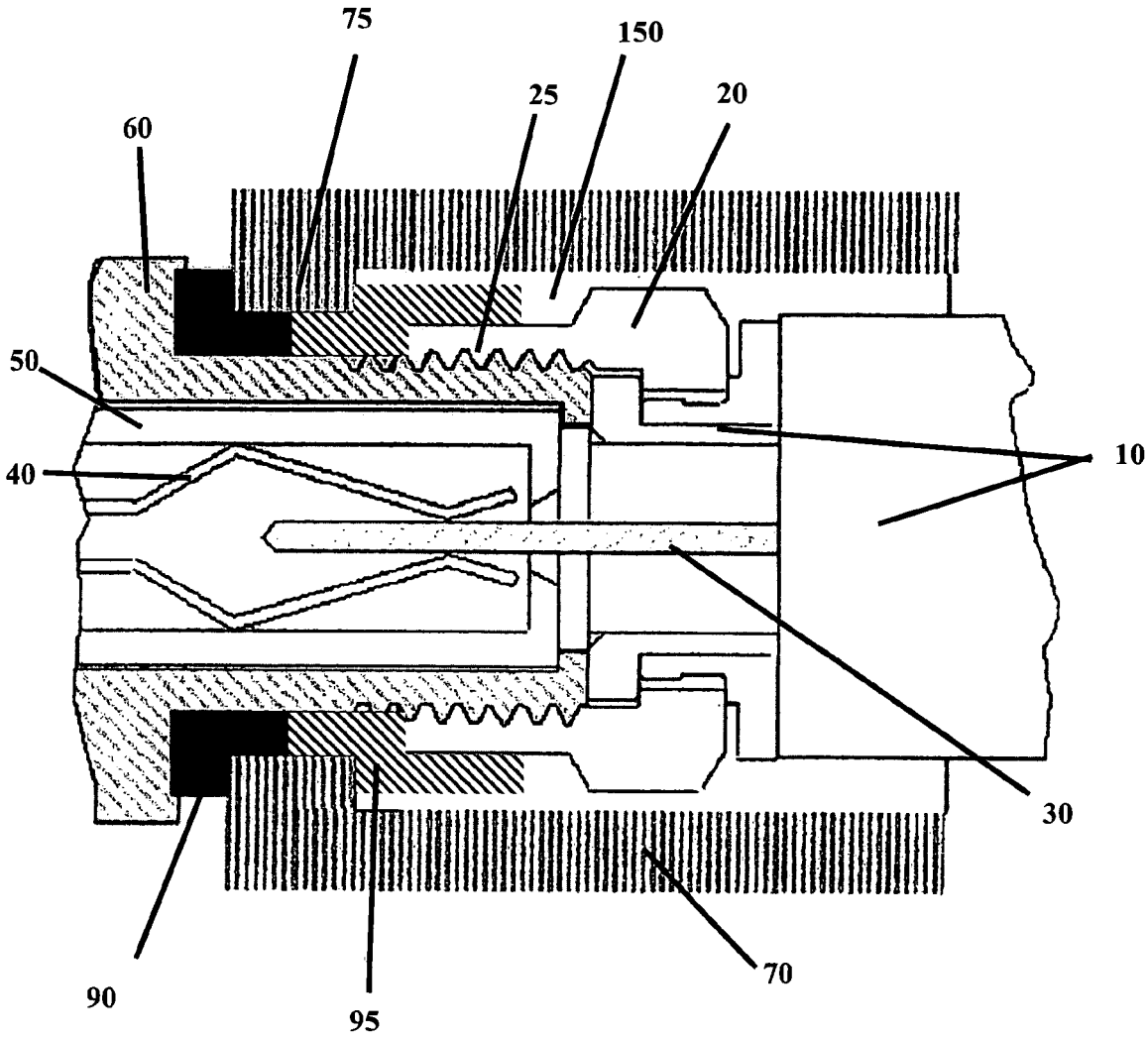
FIG. 3 shows a sectional view of a sealing security shield according to an embodiment of the invention.

Referring now to FIG. 3, another embodiment of the invention is shown, in which a port gasket 90 seals the interface between security shield 70 and port 60, while a gasket 95 seals the interface between nut 20 and port 60. Gasket 90 preferably has a L-type cross-sectional shape to fit against one edge of annular shoulder 75, and is preferably incorporated into security shield 70. Gasket 95 preferably has a flattened S-type cross-sectional shape to fit against gasket 90, another edge of annular shoulder 75, threads 25, and nut 20. When security shield 70 is installed, gaskets 90, 95 provide a weather and moisture seal, preventing moisture from penetrating into annular space 150 formed between security shield 70, male connector body 10, and nut 20. Moisture also cannot penetrate through threads 25 into receptacle 40 or port 60.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A coaxial cable security shield, wherein a coaxial cable interconnection is between a male connector and a female connector, the security shield comprising:

an annular shoulder on the security shield;

the annular shoulder being disposed on an end of the security shield and extending orthogonally inward towards a longitudinal axis of the security shield; and a gasket having a U-shaped cross-section, wherein the U-shaped cross-section is fitted to the annular shoulder of the security shield;

wherein when the security shield is fitted onto the coaxial cable interconnection, the gasket provides a seal between the security shield, the male connector, and the female connector.

2. The security shield of claim 1, wherein the female connector is an "F" port and the male connector is an "F" connector.

3. The security shield of claim 2, wherein the gasket is of an elastomeric material.

4. A method of manufacturing a security shield, comprising the steps of:

providing a security shield, the security shield having an annular shoulder on an end of the security shield and extending orthogonally inward towards a longitudinal axis of the security shield, the annular shoulder having a first planar portion at an end of the security shield, an interior circumference, and a second planar portion extending from the interior circumference to an interior circumference of the security shield, wherein the first planar portion and the second planar portion are parallel to each other and orthogonal to the longitudinal axis of the security shield; and fitting a first gasket to the annular shoulder of the security shield, wherein when the security shield is fitted onto a coaxial cable interconnection, the first gasket provides a seal between the security shield, a male connector, and a female connector.

5. A method according to claim 4, further comprising the steps of:

fitting a second gasket to an edge of the annular shoulder where the first planar portion and the interior circumference meet; and fitting the first gasket to an edge of the annular shoulder where the second planar portion and the interior circumference meet;

wherein when the security shield is fitted onto the coaxial cable interconnection, the first gasket provides a seal between the security shield and the female connector, and the second gasket provides a seal between the security shield, the female connector, and the male connector.

6. A method according to claim 5, wherein the first gasket has a flattened "S" cross-section and the second gasket has an "L" shaped cross-section.

7. A method according to claim 6, wherein the first and second gaskets are of an elastomeric material.

8. A method according to claim 4, wherein the first gasket has a U-shaped cross-section.

9. A method according to claim 4, wherein the female connector is an "F" port and the male connector is an "F" connector.

10. A method according to claim 4, wherein the first gasket is of an elastomeric material.

* * * * *